US007775369B2

(12) United States Patent
Cowling et al.

(10) Patent No.: US 7,775,369 B2
(45) Date of Patent: Aug. 17, 2010

(54) SEPARATING DEVICE AND SORTING APPARATUS WITH TWO-DIMENSIONALS ARRAY OF NOZZLES AND METHOD OF SORTING OBJECTS

(75) Inventors: Donald Cowling, Dorchester (GB); Darren Stinchcombe, Dorchester (GB); Wesley John Galliver, Dorchester (GB); George Nicholas Takel, Cardiff (GB)

(73) Assignee: Qinetiq Limited (GB)

( * ) Notice: Subject to any disclaimer, the term of this patent is extended or adjusted under 35 U.S.C. 154(b) by 675 days.

(21) Appl. No.: 10/591,507

(22) PCT Filed: Feb. 22, 2005

(86) PCT No.: PCT/GB2005/000647

§ 371 (c)(1),
(2), (4) Date: Jun. 28, 2007

(87) PCT Pub. No.: WO2005/084827

PCT Pub. Date: Sep. 15, 2005

(65) Prior Publication Data

US 2007/0278139 A1 Dec. 6, 2007

(30) Foreign Application Priority Data

Mar. 2, 2004 (GB) ..... 0404617.3

(51) Int. Cl.
*B07C 5/00* (2006.01)

(52) U.S. Cl. ..... 209/44.2; 209/524; 209/644

(58) Field of Classification Search ..... 209/639, 209/644, 44.2, 695, 522, 524, 576, 577, 580
See application file for complete search history.

(56) References Cited

U.S. PATENT DOCUMENTS 4,352,430 A * 10/1982 Maier et al. ..... 209/577
5,350,118 A * 9/1994 Mitchell et al. ..... 239/551

(Continued)

FOREIGN PATENT DOCUMENTS

CA 2 310 838 11/1998

(Continued)

*Primary Examiner*—Joseph C Rodriquez
(74) *Attorney, Agent, or Firm*—McDonnell Boehnen Hulbert & Berghoff LLP

(57) ABSTRACT

Sorting apparatus comprising conveying means for conveying input objects into to the apparatus, extraction means for extracting from the conveying means input objects identified as belonging to a particular object-class processing means arranged to received input data corresponding at least to the portions across the conveying means of said identified input objects and to output control signals corresponding to the input data to the extraction means to effect extraction of said identified input objects, where the extraction means comprises an array of nozzles extending in a direction (z) across the conveying means, each of which is independently operable under control of the processing means to produce an air jet in a generally upward direction (y), and is arranged to activate sub-groups of nozzles corresponding to, and in response to, said control signals, characterised in that the conveying means has a partially open surface arranged to convey input objects over the array of nozzles, in that the array of nozzles is two-dimensional and also extends in a direction (x) substantially parallel to the direction of motion of the conveying means when the apparatus is in use; and in that the input data further corresponds to the outline shapes of said identified input objects.

27 Claims, 5 Drawing Sheets

U.S. PATENT DOCUMENTS

| | | | | |
|---|---|---|---|---|
| 5,398,818 | A * | 3/1995 | McGarvey | 209/580 |
| 5,966,217 | A | 10/1999 | Roe et al. | |
| 6,060,677 | A | 5/2000 | Ulrichsen et al. | |
| 6,144,004 | A | 11/2000 | Doak | |
| 6,313,422 | B1 * | 11/2001 | Anibas | 209/580 |
| 2003/0132142 | A1 * | 7/2003 | Kumar | 209/579 |
| 2006/0070928 | A1 | 4/2006 | Lovhaugen et al. | |

FOREIGN PATENT DOCUMENTS

| | | |
|---|---|---|
| DE | 101 23 304 | 12/2002 |
| EP | 0 550 944 | 7/1993 |
| JP | 2000-334390 | 12/2000 |
| WO | WO 00/57160 | 9/2000 |
| WO | WO 03/061858 | 7/2003 |

* cited by examiner

SEPARATING DEVICE AND SORTING APPARATUS WITH TWO-DIMENSIONALS ARRAY OF NOZZLES AND METHOD OF SORTING OBJECTS

BACKGROUND OF THE INVENTION (1) Field of the Invention

The invention relates to sorting apparatus for sorting objects, input to the apparatus as a stream of objects, according to one or more object characteristics such as size, shape, object-material and colour. The invention relates especially, although not exclusively, to the sorting of objects in a waste stream (for example a stream of household or industrial waste) according to material-type of the objects.

(2) Description of the Art

The sorting of objects within an input stream according to a particular characteristic or set of characteristics, for example, material-type and colour, is typically a first step in a recycling process or indeed could be applied to most other processes which involve sorting of objects on a moving conveyor, such as in the food, assembly and other industries. Such sorting often involves inputting a stream of objects to a conveying means which conveys objects in the input stream past a sensing means. The sensing means identifies objects belonging to particular object-classes (each object-class being defined by one or more object-characteristics) and determines the positions of identified objects across the input stream. Data relating to object-classes of objects and their positions across the input stream is output by the sensing means and subsequently used by extraction means which physically removes identified objects from the input stream to locations (e.g. storage containers) each of which corresponds to a particular object-class. An example of this type of sorting is disclosed in U.S. Pat. No. 6,144,004. Typically, this removal process is based on an estimation of an object position on the conveyor following the sensing of a particular property at a known time on a conveyor travelling at a set velocity.

The conveying means in sorting apparatus is typically a conveyor belt. One known method of removing objects which have been identified and located from a moving conveyor belt involves use of an air-separation unit comprising a single linear row of upwardly-directed nozzles positioned at the end of the conveyor belt, and arranged substantially at ninety degrees to the direction of motion of the surface of the conveyor belt, and through which air may be blasted to produce a plurality of air jets. Each air jet is provided through an individual nozzle, and linear groups of one or more individual nozzles may be activated to provide groups of air-jets. If an object belonging to a certain object-class has been identified, knowledge of the object's position and speed (assumed to be equal to the conveyor belt speed) may be used to activate a linear group of nozzles lying in the path of the object at an appropriate moment to eject the object from the input stream, and into a receptacle. Such an arrangement may be extended to provide extraction, and hence sorting, of objects belonging to two (or more) object-classes at a single point by providing a further, downwardly-directed linear array of air jets, and further receptacles for receiving objects belonging to other object-classes. As an alternative to sorting objects belonging to a plurality of object-classes at a single position, a series of separate conveyor belts, each having a linear nozzle-array positioned at its end, may be employed to give a serial array of binary sorting positions spaced apart by conveyor belts: at each sorting position objects belonging to one object-class are ejected, with the remainder of the input stream passing onto the next conveyor belt. Such arrangements suffer from the disadvantage of requiring sensing of the objects to be carried out at each stage. Examples of these types of sorting apparatus are described in "*A Review of Automated Technology to Sort Plastics an Other Containers*", a report produced for the Canadian Plastics Industry Association and 'Corporations Supporting Recycling' (CSR, based in Ontario, Canada), and in published international application PCT/GB03/00141.

A problem associated with these types of sorting apparatus is that an air-separation unit comprising a single row of nozzles arranged substantially at ninety degrees to the direction of movement of the conveyor belt provides very unreliable ejection of objects. Also, those identified objects which are successfully ejected are ejected with widely-varying trajectories. This may lead to ejected objects colliding with each other in flight, missing collection receptacles and even falling back onto the conveyor belt, all of which reduces the efficiency of the sorting process. Furthermore, the problem of inconsistent trajectories makes sorting of objects belonging to several object-classes at a single sorting position very difficult because inconsistency of trajectory can easily result in an object falling into a receptacle that does not correspond to the object-class of that object. This means that reliable sorting into a number of object-classes generally has to be carried out using the second type of apparatus described above, viz, a serial array of conveyor belts each having a linear air separation unit at its end, i.e. apparatus having a series of binary sorting positions. This results in long, complex and expensive sorting apparatus.

SUMMARY OF THE INVENTION

It is an object of the present invention to seek to ameliorate these problems.

According to a first aspect of the invention, there is provided a separating device for removing objects from an object stream, the device comprising a two dimensional array of individually actuable air jet nozzles, a group of said nozzles being selectably actuated to remove a said object from the object stream.

Whilst air may preferably be utilised in the separating device, other gases and fluids may be substituted depending on the nature of the object stream. Thus, water jets may be utilised or indeed inert or other gases where the nature of the objects so dictates.

Preferably, the separating device includes a controller responsive to object data identifying objects in said object stream to selectably actuate said group of nozzles corresponding to an object profile contained in said object data. By carefully selecting the appropriate nozzles to form a group, the possibility of disturbing other objects in the stream and inadvertently removing them therefrom is substantially reduced. Indeed, the pitch of the nozzles may be selected so as to further ensure that the selected group removes only the desired object from the stream. Depending on the expected minimum dimensions of objects in the stream, the pitch and optionally number of nozzles may be determined. The selectable actuation of the group of nozzles may include modulation of the duration and/or strength of the one or more air jets emitted thereby. Such modulation may be based on the object data identifying objects in said stream. It will be recognised that object data may include an indication or classification of a material type e.g. metallic, cardboard, plastics material or suchlike so that an appropriate transfer of energy to the object may be achieved by actuation of the group of air nozzles. To further assist in the removal of objects from the stream the nozzles may be angled relative to the stream by an amount determined appropriate to the particular class of material. Advantageously, the angle may be varied dynamically through an actuator linked to said controller in response to object data received thereby.

Preferably, there is provided a conveyor arranged to receive said object stream, the conveyor being permeable to a gas or fluid jet emitted by said array, the array being positioned such that said conveyor is interposed between said array and said object stream. Conveniently, the object stream may be deposited on to a first or upper surface of a conveyor with the separating device being arranged so as to face a second or lower face of the conveyor, wherein the conveyor is permeable to air jets emitted by said actuable group of nozzles. Conveniently, the conveyor is a belt, advantageously an open belt such as a metal or plastics material mesh. Other permeable conveyors may include perforated chutes, parallel belts, rails and the like. It will be further appreciated that the device may be utilised with an object stream flowing under gravity.

By applying air jets to identified objects over an area corresponding to their outline shapes, apparatus of the invention ejects identified objects from an input stream with a much greater consistency than is obtainable by use of a linear array of air jets. This improves the efficiency with which identified objects are ejected from the input stream and allows objects belonging to two or more object-classes to be ejected at substantially the same sorting position, due to the higher accuracy with which ejected objects are targeted at locations corresponding to object classes. In a preferred embodiment, rather than sort multiple object types at one sorting station, a plurality of sorting stations are utilised wherein a separating device is utilised at each station to remove a particular object type. Conveniently, objects ejected from the stream are collected in receptacles positioned above the conveyor.

By using two or more two-dimensional arrays of nozzles, sorting of objects into multiple object-classes may be achieved with only a single conveyor, thus allowing such sorting with simple apparatus similar to that normally used for sorting objects belonging to only a single object-class. Alternatively, the apparatus may comprise a series of ordinary conveyor belts (having substantially impermeable surfaces), each separated by a permeable conveyor having a two-dimensional arrays of nozzles positioned below its conveying surface. Thus providing an apparatus with a series of sorting positions, but having greater extraction and sorting efficiencies than binary sorting apparatus of the prior art.

Although the prior art has tended to show the functions of identification of a given object with a particular object-class, determination of that object's position across a conveyor belt, and removal of the object to a location corresponding to its object-class, are often carried out in the same apparatus, this is not strictly necessary. For example, an input stream comprising objects belonging to various object-classes may be input to a first apparatus which identifies objects belonging to certain object-classes, and which also establishes the positions of those objects across a conveyor belt. A second apparatus may then use data from the first apparatus to effect physical removal of objects from the input stream. Thus, physical removal of objects may be carried out separately from identification of objects and determination of their positions. Hence if a sorting apparatus does not itself incorporate means for identifying objects as belonging to particular object-classes and for determining the positions of those objects, it must at least receive such information before physical extraction of objects can be effected. For the purposes of this specification, the term "sorting apparatus" may refer to either type of apparatus.

Accordingly, the apparatus may be arranged to receive data from an upstream device or sensor relating to the positions and outline shapes of objects in an input stream identified as belonging to a particular object-class (for example, objects composed of a particular material) and to pass corresponding control signals to the extraction means; alternatively the apparatus may itself incorporate means for performing these functions.

Nevertheless, according to a further aspect of the invention, there is provided a sorting apparatus of a kind defined by the pre-characterising portion of claim 11 and characterised by conveying means having a partially open surface arranged to convey input objects over a two-dimensional array of nozzles extending in a direction substantially parallel to the direction of motion of the conveying means when the apparatus is in use, and in that input data input to processing means of the apparatus corresponds to the outline shapes of input objects identified as belonging to a particular object-class, in addition to corresponding to the positions of such objects across the conveying means.

Preferably, the apparatus also comprises one or more tracking cameras arranged to track the positions of input objects on the conveying means between the position at which the input objects are input to the apparatus and the position of the array of nozzles, and to provide corresponding data to the processing means. This allows the time at which nozzles are activated to be matched more closely to the time at which an identified object passes over a nozzle array, in the event that an identified object moves on the conveying means between the time at which its position across the conveying means is determined and the time at which it arrives at the nozzle array. It will be recognised that certain object streams may be more sensitive to disturbance and hence rather than rely on an assumption that the objects have not moved between the sensing and separation thereof, further tracking may be justified.

The conveying means may comprise a meshed conveyor belt; preferably the open area fraction of the belt is at least 60% so that the air jets are not impeded to any significant extent. The material of the meshed conveyor belt may be plastic, metal, PTFE-coated fibre-glass etc. Whilst a mesh or mesh like construction is preferred, alternative conveyor arrangements in which the conveyor is permeable to an air jet are contemplated. Such alternatives include rollers, chutes and rails all of which facilitate the ejection from the conveyor of selected objects through the action of the air jet thereon.

Preferably nozzles in the array are arranged in rows having a nozzle pitch A, the pitch of the columns in a direction substantially perpendicular to the rows being A, and with adjacent columns being offset in said direction by a distance A/2. This geometry allows air jets to be more precisely applied over the whole outline shape of an identified object than would be the case if the nozzles were arranged in a simple rectangular array. In a typical object stream comprising domestic recyclable material, objects are ejected with particular efficiency and consistency of trajectory if 1 cm$\leqq$A$\leqq$2 cm. However, it will be recognised that the particular pitch will depend on the dimensions of objects in the stream and could differ from the above figure.

Each nozzle may have an independent supply of pressurised air. Alternatively, subgroups of nozzles may be connected to respective manifolds each of which has an independent supply of pressurised air: this simplifies construction of the nozzle array.

A particularly convenient nozzle construction is obtained by incorporating a valve into a nozzle, the valve being opened or closed by a solenoid in response to control signals passed to the solenoid.

Preferably the extracting means may be adjusted to vary one or more of the speed, direction and duration of the air jets produced by the array of nozzles in response to control signals from the processing means, so that the apparatus may be easily adjusted to deal with objects having different physical characteristics such as mass or surface area, for example.

A second aspect of the invention provides a method of sorting objects, the method comprising the steps of (a) conveying a stream of input objects on conveying means;

(b) identifying objects in the input stream which belong to a particular object-class;

(c) determining the positions across the conveying means of objects identified in step (b); and (d) applying upwardly-directed air-jets to an identified object at an appropriate time, and at an appropriate position in a direction across the conveying means, to remove the identified object to a location corresponding to the object-class;

characterised in that the method further comprises the steps of (e) determining the outline shapes of said identified objects;

(f) applying upwardly-directed air jets to the identified object, at the time and position specified in step (d), over an area of the object corresponding to its outline shape.

DESCRIPTION OF THE FIGURES

Embodiments of the invention are described below by way of example only and with reference to the accompanying drawings in which.

DETAILED DESCRIPTION OF THE INVENTION

Figure 1:
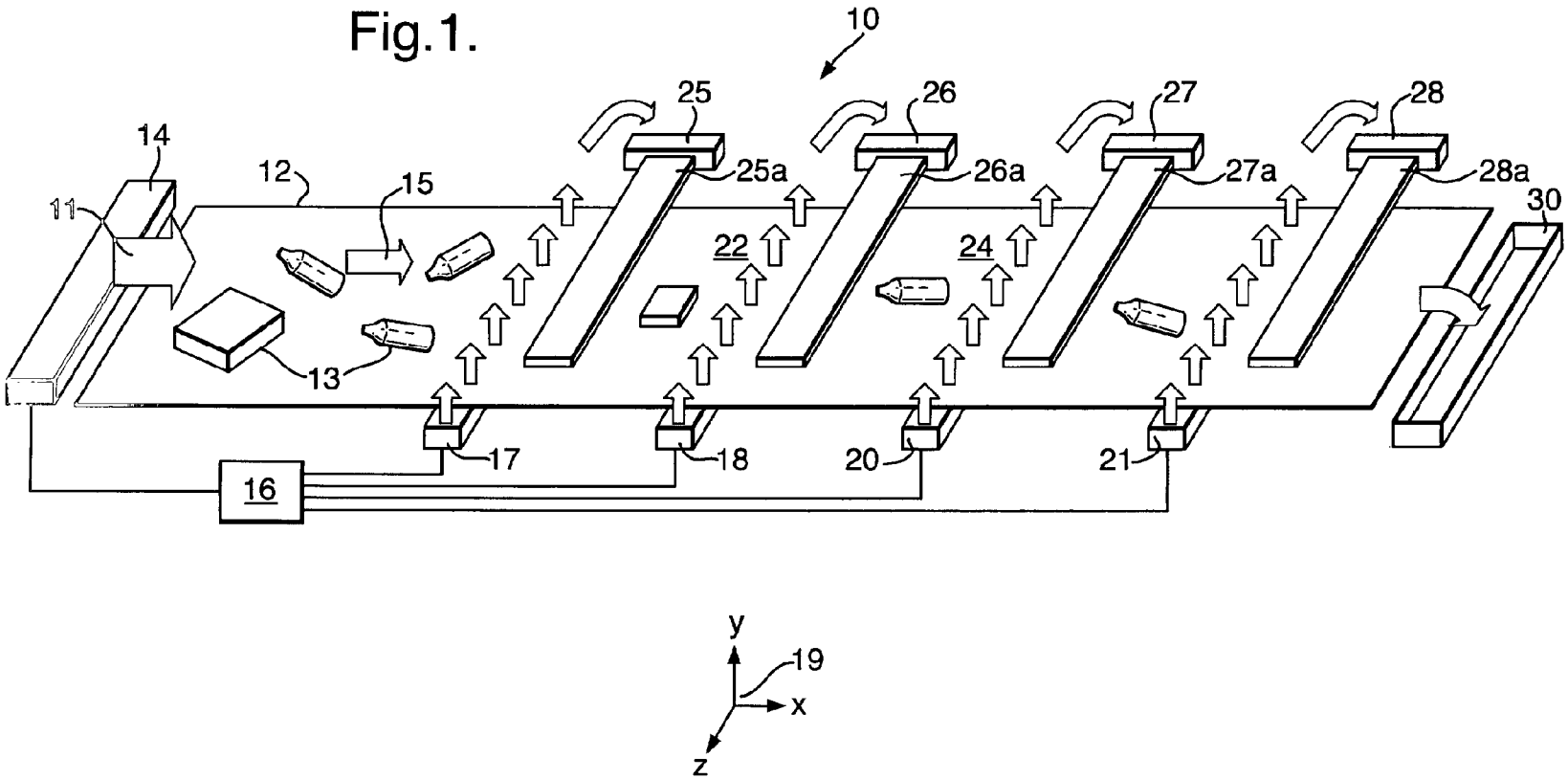
FIG. 1 schematically illustrates a sorting apparatus of the invention.

In FIG. 1, sorting apparatus incorporating an embodiment of a separating device of the invention is indicated generally by 10 and referred to Cartesian axes 19. The apparatus 10 comprises a meshed conveyor belt having an upper surface 12 and a typical width in the z-direction of 1.5 to 2 m, a sensor suite 14, a controller (hereinafter referred to also as a processing means) 16, separating devices (hereinafter also referred to as air-separation units) 17, 18, 20 and 21 and receptacles 25, 26, 27, 28, for receiving and storing sorted objects fed by respective conveyors 25*a*, 26*a*, 27*a*, and 28*a* arranged above and orthogonal to the meshed conveyor belt. A residue receptacle 30 receives unseparated waste from the end of the conveyor belt. The sensor suite 14 includes a hyperspectral imaging system able to identify and further classify organic, plastics material, composite and metallic objects on the basis of the reflectivity of objects in several spectral bands. The sensor suite 14 further includes a tracking camera able to detect the positions of such objects across the conveyor belt 12 in the z-direction and to capture their outline shapes in the xz plane. Although not utilised in this embodiment, additional or alternative sensors may be provided within the suite 14 to provide further or different sensing capability e.g. a metal detector/colour detection. The air-separation units 17, 18, 20, 21 each comprise a two-dimensional array of upwardly-directed nozzles in the xz plane and are separated by respective distances $x_1$, $x_2$, $x_3$, $x_4$ from the sensor suite 14. Under control of the processing means 16, groups of nozzles in the units 17, 18, 20, 21 may be activated so that individual nozzles within the groups produce air jets which are directed in a generally upwards direction and through the upper surface 12 of the meshed conveyor belt. The air-separation units 17, 18, 20, 21 are described in greater detail below. The meshed conveyor belt preferably has an open area fraction of 60% or more.

The apparatus 10 operates as follows. The meshed conveyor belt is switched on so that its upper surface 12 typically moves at a uniform speed of between 1.5 to 2 $ms^{-1}$ in the direction of arrow 15. A stream 13 of input objects to be sorted is input to the apparatus 10 as indicated by arrow 11. Objects in the stream 13 are conveyed by the upper surface 12 of the meshed conveyor belt past the sensor 14 in the direction of the arrow 15. The sensor suite 14 is connected to processing means 16, and the sensor suite 14 and processing means 16 operate together to identify and classify material types such as particular plastics materials, composites, organic and metals in the input stream 13, and to determine the positions of such objects across the upper surface 12 of the meshed conveyor belt (i.e. in the z-direction). For each identified object, the processing means 16 stores a data set corresponding to the object's outline shape in the xz plane, the object's material, its position across the conveyor belt and time of identification by the sensor 14 and processing means 16. In the following, reference is made to two broad classes of material namely metals and plastics. It will be recognised that the sensing means may be capable of identifying particular types of metals, plastics and other materials and that the sorting devices may be actuated accordingly so as to eject a particular class or classes of plastics, metal, composite or organic materials. Furthermore, although in this embodiment, the following refers to the actuation of sorting devices at just two of the four sorting stations shown in FIG. 1, the processing means could equally be programmed to actuate sorting devices at the sorting stations unutilised in this particular example with relevant modification to timing of actuation and so on of the separation devices in accordance with the general principle of the operation of the system set out herein. For example, more than one sort station may be utilised to sort different classes of plastics material or indeed other classes of metal, composite or organic material. Indeed, more than four sort stations may be utilised in certain embodiments of the invention.

In the following, it is the case that a sort station 18 is utilised for extracting plastics materials and a further sort station 20 is designated for metal materials. In general, if a particular object is identified at time t as being made of a particular class of material, e.g. a plastics material, as it passes the sensor 14, then at time $t'=t+(x_2/v)$ the processing means 16 outputs a control signal to the air-separation unit 18 so that a group of nozzles in the unit 18 is activated to provide upwardly-directed air jets through a region 22 of the upper surface 12 of the meshed conveyor belt, the group corresponding to the outline shape and x-z-position of the plastics material object. v is the speed of the conveyor belt. The direction and air speed of the air jets is sufficient to blast the plastics material object off the upper surface 12 of the conveyor belt and onto the orthogonal belt 26*a* and thence into the receptacle 26. Similarly, if an object is identified as being made of a particular class of metal when it passes the sensor 14 at a time t, then at a time $t'=t+(x_2/v)$ the processing means 16 outputs a control signal to the air-separation unit 20 so that a group of nozzles in the unit 20 is activated to provide upwardly-directed air jets through a region 24 of the upper surface 12 of the meshed conveyor belt corresponding to the outline shape and the x-position of the metal object. The direction and force of the air jets is arranged to blast the metal object off the upper surface 12 of the conveyor belt and onto the orthogonal belt 27*a* and thence into the receptacle 27. In this example, objects in the input stream 13 which are not identified as being composed of metal or plastic are not subjected to air jets from either of the air-separation units 18, 20 and fall into receptacle 30 under gravity when conveyed to the end of the meshed conveyor belt. In this embodiment, the apparatus 12 thus operates to extract and separate different classes of metal and plastic material objects, with objects not positively identified as being of the desired class of metal, plastics or other material being passed to a single receptacle 30.

Figure 2:
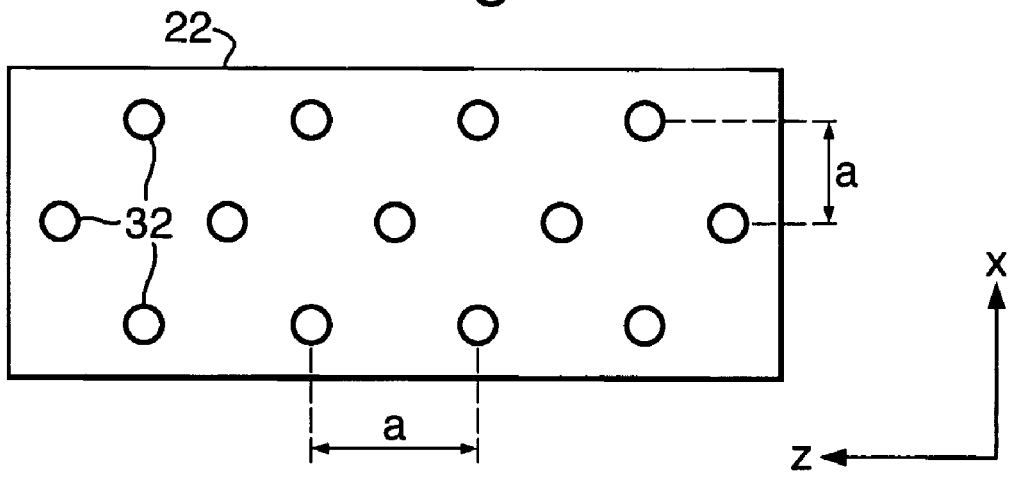
FIG. 2 shows a plan view of a matrix of nozzles comprised in the FIG. 1 apparatus.

FIG. 2 shows a plan view of the region 22 of the apparatus 10 with the meshed structure of the conveyor belt omitted to give a clear view of the arrangement of nozzles 32 within the region 22. The nozzles 32 of the air-separation unit 18 are arranged in a regular two-dimensional array. The nozzles 32 within a particular column extending in the z direction are spaced apart by a pitch A of approximately 1 to 2 cm, and rows in the x direction are themselves spaced apart by the same pitch A in the z direction. Adjacent columns extending in the z-direction are offset in the x-direction by a distance A/2.

Figure 3:
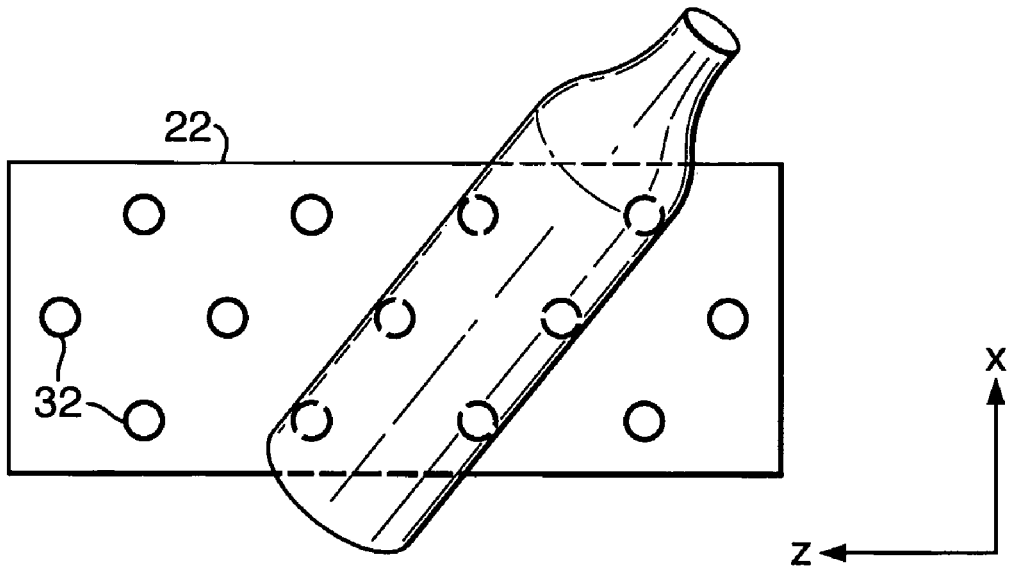
FIG. 3 illustrates operation of the FIG. 2 matrix of air nozzles to remove an object from a stream of objects.

FIG. 3 illustrates a plastics material bottle passing over the region 22. Six of the nozzles 32 fall within the outline shape of the bottle. At time t the bottle has been identified as being composed of a particular plastics material and its outline shape in the xz plane and its position in the z-direction have also been established and stored in the processing means 16. The processing means 16 uses this information to generate a control signal to activate the six nozzles within unit 18 at time $t'=t+(x_2/v)$ so as to blast the plastic bottle off the meshed conveyor belt and onto the orthogonal conveyor 26*a* before being deposited into receptacle 26. Since air-separation is effected by a two-dimensional array of air jets distributed across the outline of a plastic object as it passes the region 22, the trajectories of ejected plastic objects are more consistent than those that could be achieved by a single row of air jets extending in the z-direction. The reason for this is two-fold: first, at least some of the force applied to the object passes through its centre of mass giving better reliability of ejection and reduced rotation of ejected objects, and, second, the adverse effects of mis-timing of the application of the air-jets, due to some unavoidable movement of an object on the belt surface 12 as it moves between the sensor 14 and the region 22, are reduced due to an extent of air-jets in the x-direction. In this example, the same considerations apply to the ejection of metal objects as they pass the region 24.

In order to maximise ejection efficiency, the nozzles of the air-separation units 17, 18, 20 and 21 should be mounted as close as possible to the underside of the upper surface 12 of the meshed conveyor belt. The meshed conveyor belt may be made of any material normally used for such devices, for example plastic, metal, or PTFE-coated fibre glass.

To provide for further improvement in ejection efficiency and reliability, and in the consistency of the trajectories of ejected objects, the processing means 16 may be arranged, based on a classification of the material type and perhaps the object outline to estimate the weight or other physical characteristic of the identified object on the conveyor belt. The classification will, of course, be made on the basis of the data received from the sensor suite 14, with the ejection units 17, 18, 20 and 21 being arranged to adjust one or more of the magnitude, direction and duration of force delivered to an identified object according to the estimate of the physical characteristic of the object. Accordingly, data corresponding to an object's characteristics is included within control signals output from the processing means 16 to the air-separation units 17, 18, 20 and 21.

In a variant of the apparatus 50 described in more detail below with reference to FIG. 6, one or more tracking cameras are provided between the sensor and the ejection units to provide for continuous tracking of identified objects as they move in the x-direction between the sensor 14 and the ejection units. Positional information relating to identified objects is passed to the processing means from the tracking camera or cameras: this allows for the timing of the application of air jets to be varied slightly to compensate for any movement of identified objects on the conveyor belt as they are conveyed between the sensor and the ejection units and in particular where the objects are transferred between conveyors. This provides a further improvement in ejection reliability and efficiency, and in consistency in the trajectories of ejected objects.

The nozzles of each of the air-separation units 17, 18, 20 and 21 are independently controllable, so as to allow accurate application of air jets to an identified object across its outline in the xz plane. Each nozzle has a valve and a solenoid connected to the valve for opening and shutting the valve in response to electrical signals applied to the solenoid.

Figure 4:
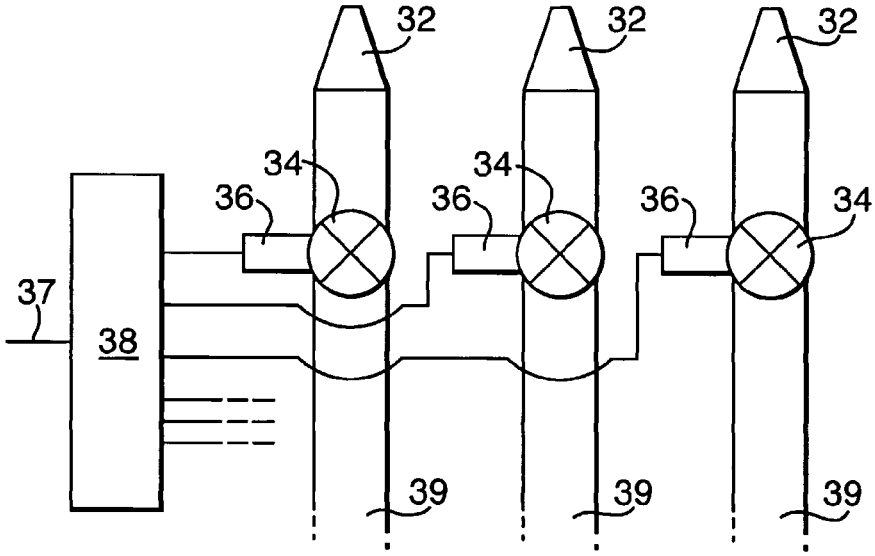
FIGS. 4 and 5 show alternative architectures for air separation units comprised in the FIG. 1 apparatus.

FIG. 4 illustrates one suitable scheme for an air-separation unit and shows three nozzles 32 each having a valve 34 and solenoid 36 for controlling the valve 34. Each nozzle 32 has an independent pressurised air supply 39, generated by standard means (not shown). A processor 38 receives control signals from the processing means 16 of the apparatus 10 at an input 37, and outputs control signals to one or more solenoids 36 in order to activate one or more nozzles 32 to provide air jets over an area corresponding to the outline shape of an object to be ejected when the object moves over the air-separation unit.

Figure 5:
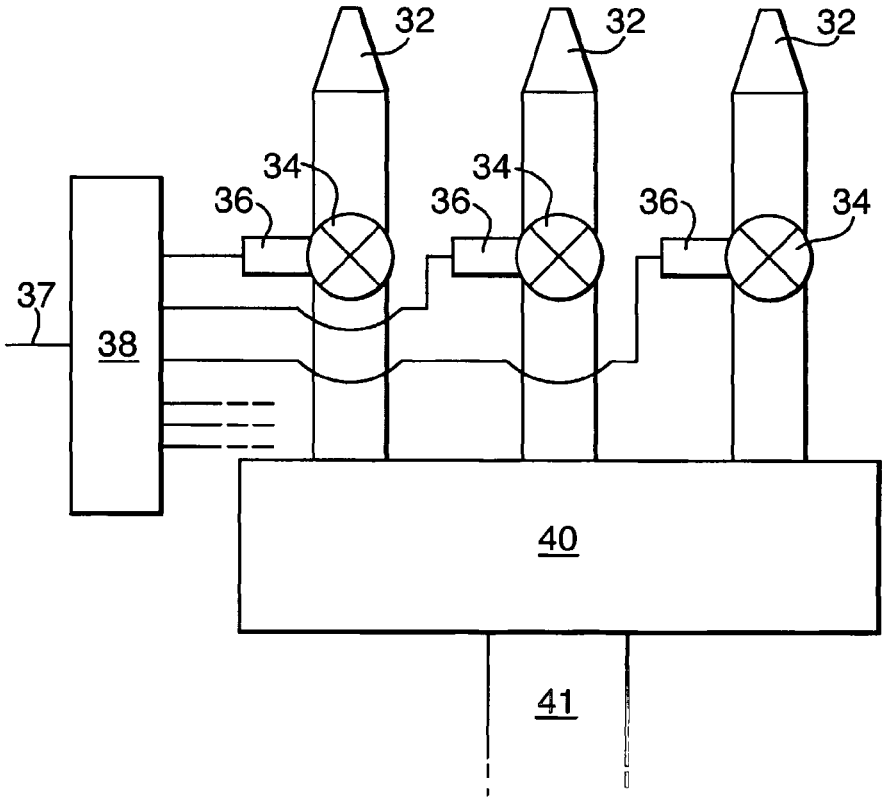

FIG. 5 show an alternative scheme in which a pressurised air supply is introduced to a manifold 40 via a single input 41. The manifold provides air to a group of nozzles 32 but the valves 34 of individual nozzles 32 are again controlled by individual solenoids 36 which receive control signals from a processor 38. The FIG. 5 scheme provides a simpler architecture for the air separation units 17, 18, 20, 21 than does the scheme of FIG. 4.

The pitch A and number of nozzles 32 in the air-separation units 17, 18, 20 and 21 may be varied depending on the typical size of objects to be ejected. The apparatus 10 may be used for example to sort household waste, or industrial waste generated by shredding of cars, refrigerators, electrical equipment etc.

Figure 6:
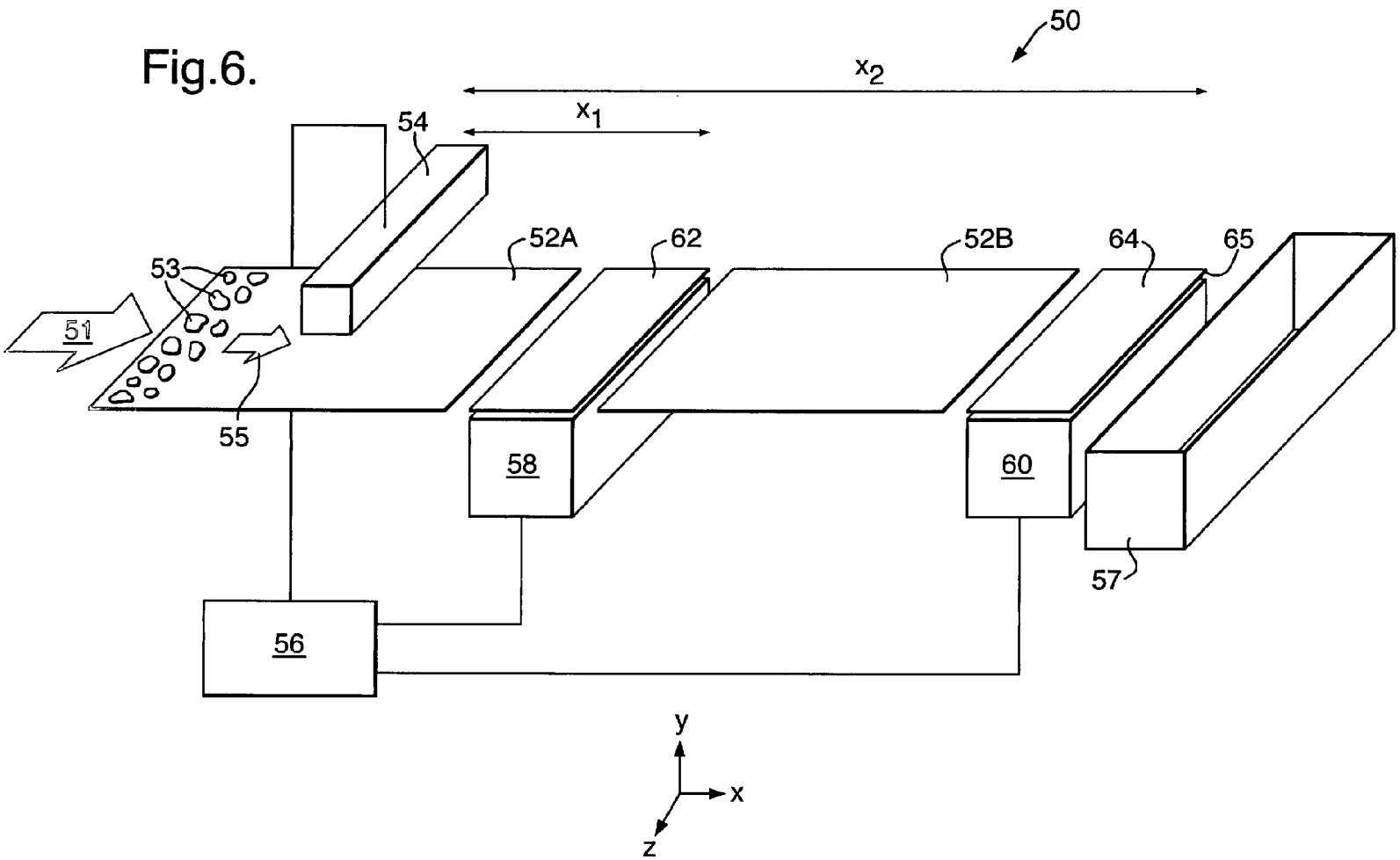
FIG. 6 schematically illustrates another sorting apparatus of the invention.

FIG. 6 shows another embodiment of the invention, indicated generally by 50. The apparatus 50 comprises sensing means 54 (including for example a hyperspectral imaging system and a tracking camera), processing means 56, air-ejection units 58, 60, first and second ordinary (substantially impermeable) conveyors belts having (fully closed) upper surfaces 52A, 52B and first and second meshed conveyor belts having upper surfaces 62, 64 positioned above air-separation units 58, 60 respectively. The width of the conveyor belts in the z-direction is typically 2 m. The apparatus 50 also comprises two further receptacles (not shown in the interests of clarity): one is positioned above the conveyor belt surface 52B and the other is positioned above the receptacle 56. The air-separation units 58, 60 are of the same design as units 17, 18, 20 and 21 in the apparatus 10 of FIG. 1. Furthermore, in this embodiment, the separation unit 58 is used for removing plastics materials and separation unit 60 is used for removing metal materials. However, it should be recognised that the separation units 58, 60 could also be configured to remove other materials e.g. composite materials or indeed subsets of those materials including the plastics and metals referred to above.

The apparatus 50 operates to separate plastics materials, composites, organic and metal objects from a stream of objects input to the apparatus 50 in a direction 51. In operation of the apparatus 50 the conveyor belts are operated so that their respective upper surfaces 52A, 62, 52B, 64 move in the x-direction at a typical speed $v=2\ ms^{-1}$. Objects 53 input to the conveyor belt surface 52A are conveyed past the sensing means 54 in a direction 55, and the sensing means 54 and processing means 56 operate to identify plastics material, composites, organic and metal objects, their outline shapes, and their positions in the z-direction. All objects 53 in the input stream are conveyed on the closed upper surface 52A of the first conveyor belt to a second conveyor belt having a meshed upper surface 62 which passes over air-separation unit 58. Objects in the input stream which are identified as being composed of plastics material or indeed of a particular class of plastics material are blasted off the surface 62 of the meshed conveyor belt and into a receptacle (not shown) positioned above the surface 52B of the second ordinary conveyor belt. The remainder of the input stream is conveyed on the closed upper surface 52B of the second ordinary conveyor belt to a second meshed conveyor belt having a meshed upper surface 64 which passes over a second air-separation unit 60. The transition between conveyors may be facilitated by an appropriate roller or transfer belt so as to ensure the timing information is not corrupted by hindering the movement of the objects between the conveyors. Objects identified by the sensor 54 and the processing means 56 as being composed of a particular class of metal material are blasted off the surface 64 by air jets from the unit 60 and into a receptacle (not shown) positioned above the receptacle 56. Objects not identified as being composed of either the selected class or classes of metal or plastics material fall under gravity into the receptacle 56 on reaching end 65 of the second meshed conveyor belt.

The apparatus 50 of FIG. 6 provides binary sorting at two x-positions in order to extract objects belonging to two object-classes, whereas the apparatus 10 of FIG. 1 achieves the same function by ternary sorting at substantially a single x-position.

Figure 7A:
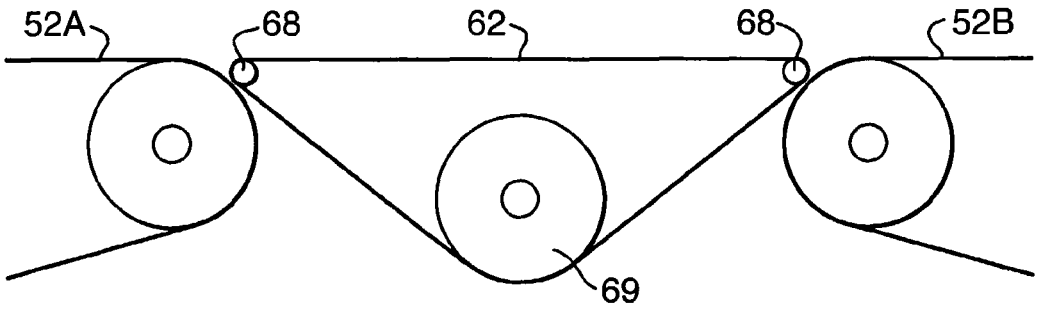
FIGS. 7A and 7B illustrate an air ejection system employed in the FIG. 6 apparatus.

FIG. 7A shows a side view of a portion of the apparatus 50 including the first meshed conveyor belt which has an upper surface 62. To provide for a smooth transfer of object to and from the surface 62, end rollers 68 of the first meshed conveyor belt have a small diameter, enabling the surface 62 to be in close proximity to the surfaces 52A, 52B of the first and second standard conveyor belts.

Figure 7B:
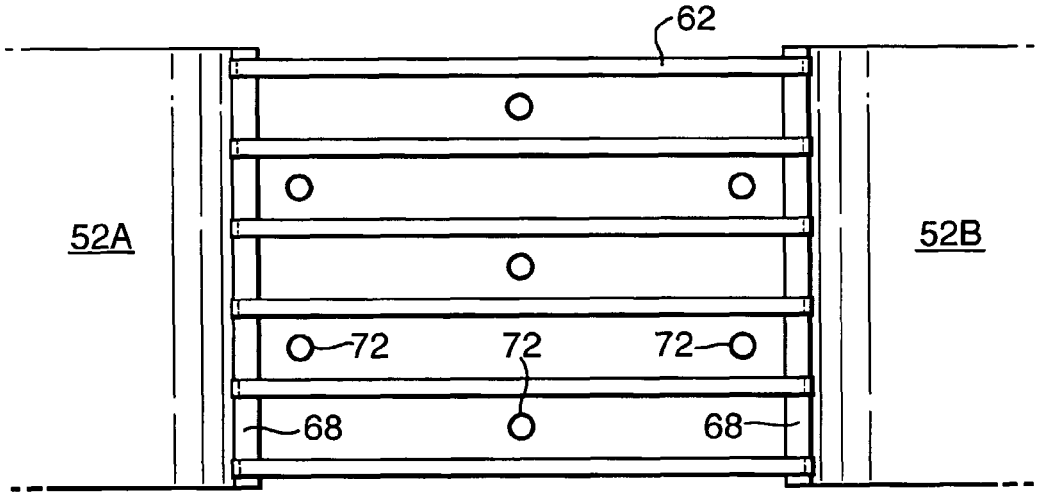

FIG. 7B shows a plan view of the portion of the apparatus 50 shown in FIG. 1. Nozzles 72 of the air-separation unit 58 are arranged to generate air-jets directed upwardly through the upper surface 62 of the first meshed conveyor belt. The air-separation unit 60 and the second meshed conveyor belt (having upper surface 64) are arranged in the same way as unit 58 and the first meshed conveyor belt.

The invention claimed is:

1. A separating device for removing objects from an object stream, the device comprising a two dimensional array of individually actuable air jet nozzles, a two dimensional group of said nozzles being selectably actuated to remove a said object from the object stream, the device further comprising a controller responsive to object data identifying objects in said object stream to selectably actuate said two dimensional group of nozzles corresponding to an object outline contained in said object data.

2. A device as claimed in claim 1, further comprising a conveyor arranged to receive said object stream, the conveyor being permeable to a gas jet emitted by said array, the array being positioned such that said conveyor is interposed between said array and said object stream.

3. A device as claimed in claim 2, wherein said conveyor comprises a meshed belt.

4. A device as claimed in claim 2, wherein said conveyor comprises a set of rollers.

5. A device as claimed in claim 1, wherein the nozzles are arranged in a substantially rectangular array of n rows by m columns.

6. A device as claimed in claim 1, wherein a plurality of nozzles are connected to a manifold.

7. A device as claimed in claim 1, wherein the nozzles are connected to a compressed air supply.

8. A device as claimed in claim 1, wherein the controller is operable in response to data identifying an object in said stream to actuate nozzles in at least two columns.

9. Sorting apparatus comprising (a) conveying means for conveying input objects input to the apparatus;

(b) extracting means for extracting from the conveying means input objects identified as belonging to a particular object-class and removing said identified input objects to a remote location; and (c) processing means arranged to (i) receive input data corresponding at least to the positions across the conveying means of said identified input objects; and (ii) output control signals corresponding to the input data to the extraction means at an appropriate time to effect extraction of said identified input objects;

wherein the extraction means comprises an array of nozzles, extending in a direction (z) across the conveying means, each of which is independently operable under control of the processing means to produce an air jet in a generally upward direction (y), and is arranged to activate groups of nozzles corresponding to, and in response to, said control signals; wherein (d) the conveying means has a partially-open surface arranged to convey input objects over the array of nozzles;

(e) the array of nozzles is two-dimensional and also extends in a direction (x) substantially parallel to the direction of motion of the conveying means when the apparatus is in use;

(f) the input data further corresponds to the outline shapes of said identified input objects; and, (g) wherein the extraction means is arranged to selectably activate a two-dimensional group of nozzles corresponding to said outline shape.

10. Apparatus according to claim 9 wherein the extraction means comprises two or more two-dimensional arrays of nozzles, the conveying means being arranged to convey input objects over the two or more arrays and each array being arranged to extract from the conveying means input objects belonging to at least one of a plurality of object-classes in response to control signals from the processing means.

11. Apparatus according to claim 9 wherein the extraction means comprises a further two-dimensional array of nozzles so that there are first and second two-dimensional arrays of nozzles and the apparatus comprises a further conveying means so that there are first and second conveying means having partially open surfaces arranged to convey input objects over the first and second arrays respectively, each array being arranged to extract from corresponding conveying means input objects belonging to at least one of a plurality of object-classes in response to control signals from the processing means.

12. Apparatus according to claim 9 further comprising means arranged to identify input objects composed of a particular material and to pass corresponding data to the processing means.

13. Apparatus according to claim 12 wherein said means arranged to identify input objects is also arranged to establish the positions of identified input objects across the conveying means and to pass corresponding data to the processing means.

14. Apparatus according to claim 13, wherein said corresponding data comprises a timestamp.

15. Apparatus according to claim 13 wherein said means arranged to identify input objects is also arranged to establish the outline shapes of identified input objects and to pass corresponding data to the processing means.

16. Apparatus according to claim 15 wherein said means arranged to identify input objects comprises an imaging sensor.

17. Apparatus according to claim 9 and further comprising one or more tracking cameras arranged to track the position of input objects on the conveying means between the position at which the input objects are input to the apparatus and the position of the array of nozzles, and to provide corresponding data to the processing means.

18. Apparatus according to claim 9 wherein the conveying means is a meshed conveyor belt.

19. Apparatus according to claim 18 wherein the meshed conveyor belt has a meshed conveying surface with an open area fraction of at least 60%.

20. Apparatus according to claim 19 wherein the meshed conveying surface is made from one of plastic, metal and PTFE-coated fibre-glass.

21. Apparatus according to claim 9 wherein nozzles in the array are arranged in rows having a nozzle pitch A, the pitch of the rows in a direction substantially perpendicular to the rows is A, and adjacent rows are offset in said direction by a distance A/2.

22. Apparatus according to claim 21 wherein $1cm \leqq A \leqq 2cm$.

23. Apparatus according to claim 9 wherein each nozzle has an independent supply of pressurised air.

24. Apparatus according to claim 9 wherein subgroups of nozzles are connected to respective manifolds each of which has an independent supply of pressurised air.

25. Apparatus according to claim 9 wherein each nozzle incorporates a valve and a solenoid arranged to open and close the value in response to control signals.

26. Apparatus according to claim 9 wherein the extracting means may be adjusted to vary one or more of the speed, direction and duration of the air jets produced by the array of nozzles in response to control signals from the processing means.

27. A method of sorting objects, the method comprising the steps of (a) conveying a stream of input objects on conveying means;

(b) identifying objects in the input stream which belong to a particular object-class;

(c) determining the positions across the conveying means of objects identified in step (b); and (d) using a separating device according to claim 1 comprising a two-dimensional array of individually actuable air jet nozzles to apply upwardly-directed air-jets to an identified object at an appropriate time, and at an appropriate position in a direction across the conveying means, to remove the identified object to a location corresponding to the object-class;

wherein the method further comprises the steps of (d) determining the outline shapes of said identified objects;

(e) applying upwardly-directed air jets to the identified object, at the time and position specified in step (d), over an area of the object corresponding to its outline shape by selectably actuating a two-dimensional group of nozzles corresponding to said outline shape.

* * * * *